United States Patent [19]

Straubel

[11] 4,354,476

[45] Oct. 19, 1982

[54] APPARATUS FOR CONTROLLING THE RECIRCULATED EXHAUST GAS QUANTITIES AND THE INJECTION QUANTITY IN AUTO-IGNITING INTERNAL COMBUSTION ENGINES

[75] Inventor: Max Straubel, Stuttgart, Fed. Rep. of Germany

[73] Assignee: Robert Bosch GmbH, Stuttgart, Fed. Rep. of Germany

[21] Appl. No.: 308,059

[22] Filed: Oct. 2, 1981

Related U.S. Application Data

[62] Division of Ser. No. 84,701, Oct. 15, 1979, Pat. No. 4,304,209.

[30] Foreign Application Priority Data

Nov. 15, 1978 [DE] Fed. Rep. of Germany ..... 2849508

[51] Int. Cl.[3] ..... F02M 25/06

[52] U.S. Cl. ..... 123/569; 123/571

[58] Field of Search ..... 123/569, 571, 568

[56] References Cited

U.S. PATENT DOCUMENTS

| | | | |
|---|---|---|---|
| 4,043,304 | 8/1977 | Stumpp et al. | 123/569 |
| 4,116,178 | 9/1978 | Saito | 123/571 |
| 4,157,081 | 6/1979 | Wake et al. | 123/571 X |
| 4,196,707 | 4/1980 | Stoltman | 123/571 |
| 4,233,947 | 11/1980 | Abo | 123/571 |
| 4,276,866 | 7/1981 | Higashiyama | 123/571 |
| 4,306,534 | 12/1981 | Wessel et al. | 123/571 |
| 4,325,348 | 4/1982 | Abe et al. | 123/571 |

FOREIGN PATENT DOCUMENTS

| | | | |
|---|---|---|---|
| 411062 | 5/1934 | United Kingdom | 123/505 |
| 2036174 | 6/1980 | United Kingdom | 123/569 |
| 2068458 | 8/1981 | United Kingdom | 123/568 |

*Primary Examiner*—Wendell E. Burns

*Attorney, Agent, or Firm*—Edwin E. Greigg

[57] ABSTRACT

An apparatus is proposed which serves the purpose of controlling the exhaust gas recirculation quantity and the injection quantity in auto-igniting internal combustion engines. In this apparatus, an arbitrarily actuatable throttle valve is provided in the intake manifold, downstream of which a control pressure is withdrawn from the intake manifold and used to actuate a pneumatic adjustment device which determines the position of the quantity adjustment device of a fuel injection pump. This control pressure simultaneously serves to actuate an exhaust gas recirculation valve and acts counter to the force of a restoring spring in the work chamber of a second pneumatic adjustment device. Thus, during idling and at full-load of the engine, little exhaust gas or none at all is recirculated and at medium-load and rpm the exhaust gas recirculation quantity is controlled in accordance with the induced air quantity, that is, according to load and rpm; at the same time, in the same sense, the suction pressure which actuates the quantity adjustment device is a standard for load and rpm, that is, for the induced air quantity. Thus with increasing suction pressure less fuel is injected, and more exhaust gas is recirculated, and at a desired high load level the power output of the engine is not impaired by exhaust gas recirculation.

7 Claims, 2 Drawing Figures

APPARATUS FOR CONTROLLING THE RECIRCULATED EXHAUST GAS QUANTITIES AND THE INJECTION QUANTITY IN AUTO-IGNITING INTERNAL COMBUSTION ENGINES

This is a division of application Ser. No. 084,701 filed Oct. 15, 1979, now U.S. Pat. No. 4,304,209, issued Dec. 8, 1981.

BACKGROUND OF THE INVENTION

The invention relates to a control apparatus in accordance with the preamble of the main claim. In a known control apparatus of this kind, in order to maintain a very precise ratio of air to fuel in an auto-igniting internal combustion engine, the recirculated exhaust gas quantity is controlled in a very expensive manner in that the recirculated exhaust gas quantity, after precise apportionment of the air quantity in relationship to the injected fuel quantity, comprises the remnant charge of the combustion chambers of the engine.

An exhaust gas recirculation valve control apparatus is also known in which the control pressure for the pneumatic adjustment device of the exhaust gas recirculation valve is a mixture of the pressure prevailing in the Venturi restriction of a carburetor and the pressure prevailing downstream of the throttle valve of the carburetor. This apparatus thus makes use of a known carburetor and is thus restricted to use in externally ignited internal combustion engines. The control pressure can be modified by means of throttles in the lines leading off from the pressure withdrawal points in such a manner that the recirculated quantity of exhaust gas corresponds approximately to particular requirements of the engine at various operational points.

Another new apparatus for setting a desired exhaust gas recirculation rate in accordance with the air quantity induced by the carburetor has a slit-like cross section in the pivoting range of the throttle valve, which cross section is also partially opened toward the intake manifold upstream of the throttle valve when the throttle valve is closed. In accordance with the extent to which the throttle valve is opened, a control pressure is attained in the work chamber of a pneumatically functioning exhaust gas recirculation valve which communicates with the slit-like cross section which pressure varies in accordance with the extent of the throttle valve opening and with the underpressure prevailing downstream of the throttle valve. In order to obtain proper proportions of recirculated exhaust gas, the cross section of the slit-like opening can be appropriately controlled. This apparatus as well relates to exhaust gas recirculation in externally ignited internal combustion engines and in particular engines which are supplied with operational mixture by carburetors.

OBJECTS AND SUMMARY OF THE INVENTION

The apparatus according to the invention having the characteristics of the main claim has the advantage over this prior art in that the control of the exhaust gas recirculation quantity can be performed in a very simple and inexpensive manner. Furthermore, favorable opportunities for intervention to provide an additional control in accordance with other operating parameters are created. The fuel quantity control means combined therewith and arranged to function pneumatically has the advantage that very satisfactory, smooth driving behavior can be attained in a vehicle driven by such an engine. A further advantage resides in the fact that the same guide value is used for the exhaust gas recirculation rate and for the injection quantity.

The invention will be better understood as well as further objects and advantages thereof become more apparent from the ensuing detailed description of two preferred embodiments taken in conjunction with the drawings.

DESCRIPTION OF THE PREFERRED EMBODIMENTS

Figure 1:
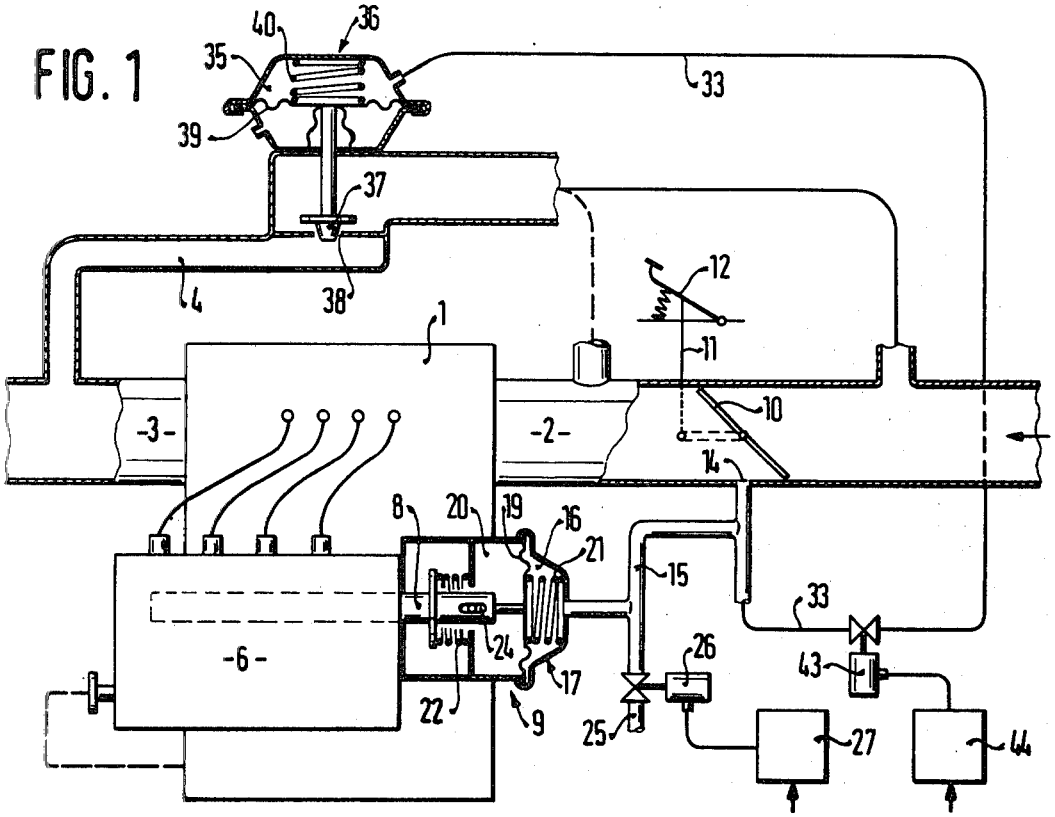
FIG. 1 is a schematic illustration of one embodiment of a fuel injection system for an internal combustion engine according to the present invention wherein exhaust gas recycling is utilized and including details illustrated partly in cross section which in assembly serve to control the exhaust gas recycling.

Shown in simplified form in the drawings are an internal combustion engine 1 with an intake manifold 2, through which air is delivered to the internal combustion engine, and an exhaust manifold 3, from which an exhaust gas recirculation line 4 leads to the intake manifold 2 of the engine. This engine is an auto-igniting internal combustion engine, which is supplied with fuel by a fuel injection pump 6, which may be, for example, an in-line injection pump as shown here. The fuel injection pump 6 is driven in a conventional manner by the engine and has a control rod 8 as its quantity adjustment device.

In order to vary the fuel injection quantity, a pneumatic controller 9 is provided in accordance with the invention, and associated therewith is a throttle valve 10. This throttle valve 10 is disposed in the intake manifold 2 and is arbitrarily actuatable via a rod 11, by means of a gas pedal 12, for instance.

Downstream of the throttle valve 10, which is in its closed position, a first pressure withdrawal point 14 is disposed in the intake manifold 2, from which a control pressure line 15 leads to the work chamber 16 of a first pneumatic adjustment device 17. The first pneumatic adjustment device 17 is an essential part of the pneumatic controller 9 and comprises a pressure box in which an adjustment diaphragm 19 is fixed, with the diaphragm being arranged to separate the working chamber 16 from a reference pressure chamber 20. The adjustment diaphragm 19 is stressed by a control spring 21 fixed in the work chamber 16 and is coupled on the other side with the control rod 8, which thus, with increasing pressure in the work chamber 16, is adjustable against the force of the control spring 21 in the direction of a smaller fuel injection quantity.

In order to perform an additionally controlled adjustment of the control rod 8, for example by means of an additional controller for the purpose of final rpm control, two control springs may be provided instead of one control spring 21; that is, as shown, there is a second compression spring 22, which directly engages the control rod 8 through an annular plate and acts in the direction of full load. The coupling between control rod 8 and adjustment diaphragm 19 then is effected, as shown, via an oblong slot 24, which permits an adjustment of the control rod 8 in the direction of a smaller quantity independently of the position of the adjustment diaphragm 19.

Thus, the pressure prevailing in the work chamber 16 is that which is established downstream of the throttle valve. This pressure is dependent on the rpm at a particular time of the engine and on the extent of opening of the throttle valve by means of which the torque intention is communicated.

The pressure is a standard for the quantity of fuel injected. The control rod 8 is brought, at high suction pressure, into a position which signifies a small fuel injection quantity, and vice versa. Adjustments can be performed by means of the initial stressing and spring characteristics of the control spring 21. Furthermore, opportunities for intervention are provided in that the work chamber 16 can be connected with the surrounding atmosphere via a connecting line 25, which may also, for example, branch off from the control pressure line 15. To this end, a valve 26 is disposed in the connecting line 25 which can be varied by means of a control apparatus 27 in accordance with operating parameters of the engine. In special cases it can be efficient to control the fuel quantity not in accordance with the pressure difference between intake manifold pressure and atmospheric pressure (i.e., the relative pressure), but rather as a function of the absolute pressure. In these cases, the diaphragm 19 and the reference pressure chamber 20 are replaced by an evacuated barometer box.

From the first pressure withdrawal point 14 or from the control pressure line 15, a pressure line 33 leads to the work chamber 35 of a second pneumatic adjustment device 36. The arrangement of elements in this device serves to actuate a valve closing member 37 in a flow-through cross section 38 of the exhaust gas recirculation line 4. Similar to the first pneumatic adjustment device, an adjustment diaphragm 39 is also provided herein. The diaphragm 39 disposed within the housing of the pneumatic adjustment device 36 encloses the work chamber 35 and in this work chamber is provided a control spring 40 that is arranged to stress the adjustment diaphragm. The adjustment diaphragm 39 is connected firmly to the valve closing member 37. The other side of the adjustment diaphragm 39 is exposed to atmospheric pressure, so that with increasing suction pressure in the work chamber 35, the diaphragm 39 urges the valve closing member 37 against the force of the control spring 40 in the opening direction.

Accordingly, the modes of operation of both adjustment devices are such that they reinforce one another. While with increasing suction pressure the fuel injection quantity is reduced, the exhaust gas recirculation quantity is simultaneously increased; that is, the fresh air component in the total quantity induced is reduced. However, in an advantageous manner, this precisely corresponds to requirements. Thus the fresh air quantity is adapted to the fuel quantity which enters the combustion chambers, and at various operational states of the engine the largest possible exhaust gas quantity which can be permitted at a certain state is supplied on the intake side.

Figure 2:
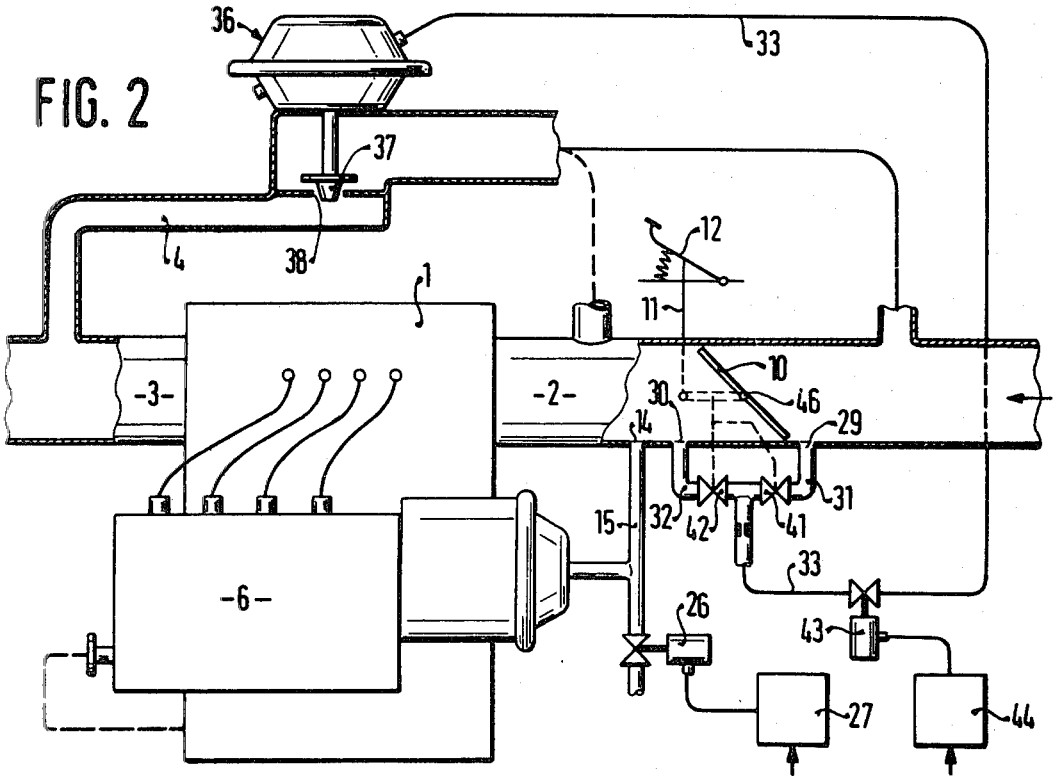
FIG. 2 is a further schematic illustration of another embodiment of this invention where dual pressure points straddle the throttle valve.

FIG. 2 illustrates a second form of the embodiment of the invention for the driving of the exhaust gas recirculation valve. In order to withdraw the control pressure, the pressure line 33 may also communicate with a separately provided pressure withdrawal point, which may be provided either at the same level as the first pressure withdrawal point 14 or, in order to adapt to the adjustment characteristic of the exhaust gas recirculation valve or for the purpose of modifying the control pressure in accordance with the position of the throttle valve, in a position in the intake manifold which is closer to the pivoting range of the throttle valve.

In the immediate vicinity of the throttle valve 10, shown in its closed position, a second pressure withdrawal point 29 is provided on the intake manifold 2, and downstream of the throttle valve on the intake manifold 2, a third pressure withdrawal point 30 is provided. A first connecting line 31 leads off from the second pressure withdrawal point 29 which together with a second connecting line 32 leading from the third pressure withdrawal point 30 leads via a common pressure line 33 to the work chamber 35 of a second pneumatic adjustment device 36. The second pneumatic adjustment device 36 serves to actuate a valve closing member 37 in a flow-through cross section 38 of the exhaust gas recirculation line 4. Similar to the first pneumatic adjustment device, an adjustment diaphragm 39 is also provided herein. The diaphragm 39 provided in the housing of the pneumatic adjustment device 36 encloses the work chamber 35, and in this work chamber is disposed a control spring 40 that is arranged to stress the adjustment diaphragm 39. The adjustment diaphragm 39 is thus firmly connected to the valve closing member 37. The other side of the adjustment diaphragm 39 is exposed to atmospheric pressure, so that the diaphragm, at increasing suction pressure in the work chamber 35, urges the valve closing member 37 in the opening direction against the force of the control spring 40. The higher the suction pressure is, the smaller the fuel metering quantity becomes and thus the higher the exhaust gas recirculation quantity becomes. The flow-through cross sections of at least one of the connecting lines 31, 32 or the pressure line 33 can be calibrated by means of a throttle. In an advantageous manner, a throttle 41 is disposed in the first connecting line 31 and a throttle 42 is disposed in the second connecting line 32. As a result of this throttle 41, the penetration effect on the work chamber 35 of the pressure prevailing upstream of the throttle valve 10 can be fixed in comparison with the penetration effect thereon of the pressure prevailing downstream of the throttle valve 10. Further opportunities for intervention are provided in that a valve 43 is disposed in the pressure line 33 which is actuatable by a control apparatus 44 in accordance with engine operating parameters. This valve may also be disposed in one of the connecting lines 31 or 32.

An adjustment of the resulting control pressure in desired operational ranges also can be attained by means of fixing the distances of the second pressure withdrawal point 29 and that of the third pressure withdrawal point 30 from the shaft 46 of the throttle valve 10. Furthermore, as is known in carburetors, the pressure withdrawal points 29 and/or 30 can also be distributed on the intake manifold circumference in the pivoting range of the throttle valve, or may comprise a plurality of bores disposed in this region and interconnected downstream with one another, in order to exploit the geometric cross-sectional relationships in the case of an opening throttle valve for the purpose of modification of the control pressure. The pressure withdrawal points 29 and/or 30 can further be controlled by means of a separate slide apparatus actuatable in common with the throttle valve.

While in the exemplary embodiment of FIG. 2 a control pressure which is at first substantially unmodified is thus at the disposal of the first pneumatic adjustment device 17, the control pressure supplied to the second pneumatic adjustment device 36 is very much dependent on the particular setting of the throttle valve 10. In the closing position of the throttle valve 10, the atmospheric pressure present at the second pressure withdrawal point 29 predominates, so that the closing device 37 is substantially closed. Accordingly, during idling, little exhaust gas or none at all is recirculated, which has the advantage that as a result of an increased inert gas component the mixture appearing in the combustion chamber of the engine does not run up against the running limit or the smoke limit; that is, it ignites only in delayed fashion or not at all. The connecting line 31 and the connecting line 32 together, in this case, have the sole function of a bypass line, wherein the quantity of bypass air can be severely restricted by means of the throttles 41 and 42.

At medium load, the second pressure withdrawal point 29, because of the throttle valve 10 which then is located in the partially open position, also enters the effective region of the suction pressure arising downstream from the throttle valve 10. Depending on the extent to which the throttle valve is opened, however, the atmospheric pressure present upstream of the throttle valve 10 also has an influence, so that an average pressure is established between the atmospheric pressure and the maximum suction pressure created. The valve closing member 37 is accordingly also brought into a middle position or a completely open position.

When the throttle valve 10 is fully open, the atmospheric pressure prevailing upstream of the throttle valve can also penetrate into the intake manifold portions located downstream of the throttle valve 10; that is, the suction pressure existing there previously is broken down. Now, this control pressure located near the level of atmospheric pressure moves through the pressure line 33 to the work chamber 35 and causes the valve closing member 37, under the effect of the control spring 40, to move in the closing direction. As a result of the initial stressing and the characteristic of the control spring 40, in combination with the previously listed possibilities for control pressure modification, the exhaust gas recirculation rates at various operational states of the engine may be optimally set in a simple and empirically ascertainable manner.

Furthermore, in particular in the case of pneumatic controllers, the use of pressure boxes as pneumatic adjustment devices permits compensation for the influence of atmospheric pressure fluctuations on the mixture composition appearing in the combustion chamber. The control apparatuses 27 and 44 may be of either mechanical or electronic type. With the control apparatus 27, a maximum rpm to be maintained may also be ascertained, for example, and regulated by means of closing the valve 26 when the rpm is exceeded.

Furthermore, the pressure withdrawal for the first pneumatic adjustment device 17 can be undertaken in accordance with the same principle and with the same features of adjustment to the requirements of the engine performance graph as is the case in known pneumatic controllers for fuel injection pumps.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for controlling an exhaust gas recirculation quantity and a fuel injection quantity in autoigniting internal combustion engines including an intake manifold, an arbitrarily actuatable throttle valve disposed in said intake manifold, said throttle valve arranged to vary air input pressure prevailing substantially downstream therefrom, a quantity adjustment device of a fuel injection pump which supplies fuel to said engine, a first pneumatic adjustment device operatively connected with said quantity adjustment device for controlling the supply of fuel to said engine, first pressure supply means connected to a first pressure withdrawal point on said intake manifold downstream of said throttle valve between said intake manifold and said first adjustment means to supply pressure to said first adjustment device for controlling fuel supplied to said engine, an exhaust gas recirculation valve, a second pneumatic adjustment device operatively connected to said exhaust gas recirculation valve for controlling said valve, a first connecting line connected to a second withdrawal point on said intake manifold immediately upstream of said throttle valve, a second pressure connecting line connected to a third pressure withdrawal point downstream of said throttle valve said first and second connecting lines connected to a common pressure line, said common line connecting said first and second connecting lines to said second pneumatic adjusting device for controlling said exhaust gas recirculation valve.

2. An apparatus in accordance with claim 1, further wherein said pressure withdrawal points have a plurality of means defining openings distributed on the intake manifold circumference, said means defining said openings being arranged to communicate with each other.

3. An apparatus in accordance with claim 1, further wherein said first connecting line and said second connecting line discharge into said common pressure line which leads to a work chamber in said second pneumatic adjusting device and that a throttle means is disposed in at least one of said connecting lines.

4. An apparatus in accordance with claim 1, further wherein a valve is disposed in the first connecting line and/or in the second connecting line, said valve arranged to be actuated in accordance with variations of the pressure in said work chamber and controllable by predetermined parameters.

5. An apparatus in accordance with claim 3, further wherein a valve controllable in accordance with operating parameters of the common engine is disposed in the pressure line.

6. An apparatus in accordance with claim 1, further wherein said first pneumatic adjustment device and said second pneumatic adjustment device each have an adjusting diaphragm, said diaphragm arranged to be stressed by said control pressure against the force of a control spring.

7. An apparatus in accordance with claim 4, further wherein said work chamber of said first pneumatic adjustment device can be connected with the surrounding air via a connecting line and that a valve is disposed in the connecting line, said valve being arranged to be actuated in accordance with additional engine parameters.

* * * * *